US006158546A

United States Patent [19]

Hanson et al.

[11] Patent Number: 6,158,546

[45] Date of Patent: Dec. 12, 2000

[54] STRAIGHT THROUGH MUFFLER WITH CONICALLY-ENDED OUTPUT PASSAGE

[75] Inventors: Roger D. Hanson, Jackson; Dale E. Sterrett, Grass Lake, both of Mich.

[73] Assignee: Tenneco Automotive Inc., Lake Forest, Ill.

[21] Appl. No.: 09/339,996

[22] Filed: Jun. 25, 1999

[51] Int. Cl.[7] ..... F01N 1/00

[52] U.S. Cl. ..... 181/255; 181/247; 181/249; 181/269

[58] Field of Search ..... 181/255, 247, 181/248, 249, 252, 256, 269, 272, 212; 60/299; 1/302; 422/180

[56] References Cited

U.S. PATENT DOCUMENTS

| | | | |
|---|---|---|---|
| 1,924,605 | 8/1933 | Haas et al. . | |
| 2,150,530 | 3/1939 | Warsing . | |
| 2,529,136 | 11/1950 | Carlson | 181/48 |
| 2,567,568 | 9/1951 | Lievense et al. . | |
| 2,958,388 | 11/1960 | Paulsen . | |
| 3,348,629 | 10/1967 | Cassel . | |
| 3,471,265 | 10/1969 | Ciapetta et al. . | |
| 3,679,024 | 7/1972 | Kirkland, Jr. et al. . | |
| 4,143,739 | 3/1979 | Nordlie . | |
| 4,267,899 | 5/1981 | Wagner et al. . | |
| 4,296,832 | 10/1981 | Kicinski . | |
| 4,368,799 | 1/1983 | Wagner . | |
| 4,580,657 | 4/1986 | Schmeichel et al. . | |
| 4,601,168 | 7/1986 | Harris | 60/299 |
| 4,683,978 | 8/1987 | Venter | 181/280 |
| 4,690,245 | 9/1987 | Gregorich et al. . | |
| 4,834,214 | 5/1989 | Feuling | 181/249 |
| 4,841,728 | 6/1989 | Jean et al. . | |
| 4,846,302 | 7/1989 | Hetherington . | |
| 4,872,528 | 10/1989 | Goplen et al. . | |
| 5,012,891 | 5/1991 | Macaluso . | |
| 5,173,576 | 12/1992 | Feuling . | |
| 5,183,976 | 2/1993 | Plemons, Jr. | 181/264 |
| 5,200,582 | 4/1993 | Kraai, Jr. et al. . | |
| 5,321,215 | 6/1994 | Kicinski | 181/211 |
| 5,345,762 | 9/1994 | Lutze | 60/288 |
| 5,355,973 | 10/1994 | Wagner et al. . | |
| 5,783,782 | 7/1998 | Sterrett et al. . | |
| 5,828,013 | 10/1998 | Wagner et al. | 181/255 |

*Primary Examiner*—Robert E. Nappi
*Assistant Examiner*—Edgardo San Martin
*Attorney, Agent, or Firm*—Harness, Dickey & Pierce, P.L.C.

[57] ABSTRACT

The present invention provides a muffler which has an outlet tube with a funnel shaped element having a large diameter end positioned in an expansion chamber and conically tapering to a junction with a cylindrical neck element extending into an inlet end of an outlet tube. An inlet tube is supported by an outer shell which also supports the outlet tube. The inlet tube is attached to the outer shell by a first partition and a first end cap, forming a tuning chamber. The outlet tube is attached to the outer shell by the funnel shaped element and a second end cap, forming an outlet chamber. A space defined by the distance between the first partition and the second partition and the geometry of the outer shell forms an expansion chamber. The three different chambers serve to either tune or quiet the exhaust coming from an internal combustion engine, and the funnel shaped element serves to smooth the flow of exhaust from the inlet tube to the outlet tube.

10 Claims, 1 Drawing Sheet

STRAIGHT THROUGH MUFFLER WITH CONICALLY-ENDED OUTPUT PASSAGE

BACKGROUND OF THE INVENTION

I. TECHNICAL FIELD

The present invention relates generally to a muffler and, more particularly, to a straight through muffler with a funnel shaped inlet to the outlet tube.

II. DISCUSSION

Exhaust systems provide a passage for combustion gases to travel from the engine, where the gases are created, to the surrounding atmosphere. Modern day automotive exhaust systems provide other functions, besides that which is discussed above, including the reduction and tuning of noise generated by the engine. Current muffler systems, such as that disclosed in U.S. Pat. No. 4,368,799 ('799 patent) generally disclose the use of multiple chambers (20), (21) and (22), located around main exhaust tubes (15) and (16) to abate and tune noise generated by the engine to effect a quieter and more pleasing sound. However, the use of multiple chambers and multiple gas flow paths creates a certain amount of back pressure, which reduces the efficiency of the engine and is therefore undesirable. This characteristic is very profound in diesel engines. The present invention was developed in light of this drawback.

SUMMARY OF THE INVENTION

The present invention addresses the aforementioned drawbacks, among others, by providing a muffler which has an outlet tube with a funnel shaped element having a large diameter end positioned in an expansion chamber and conically tapering to a junction with a cylindrical neck element extending into an inlet end of an outlet tube. An inlet tube is supported by an outer shell which also supports the outlet tube. The inlet tube is attached to the outer shell by a first partition and a first end cap, forming a tuning chamber. The outlet tube is attached to the outer shell by the funnel shaped element and a second end cap, forming an outlet chamber. A space defined by the distance between the first partition and the second partition and the geometry of the outer shell forms an expansion chamber. The three different chambers serve to either tune or quiet the exhaust coming from an internal combustion engine, and the funnel shaped element serves to smooth the flow of exhaust from the inlet tube to the outlet tube.

Additional advantages and features of the present invention will become apparent from the subsequent description and the appended claims taken into conjunction with the accompanying drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
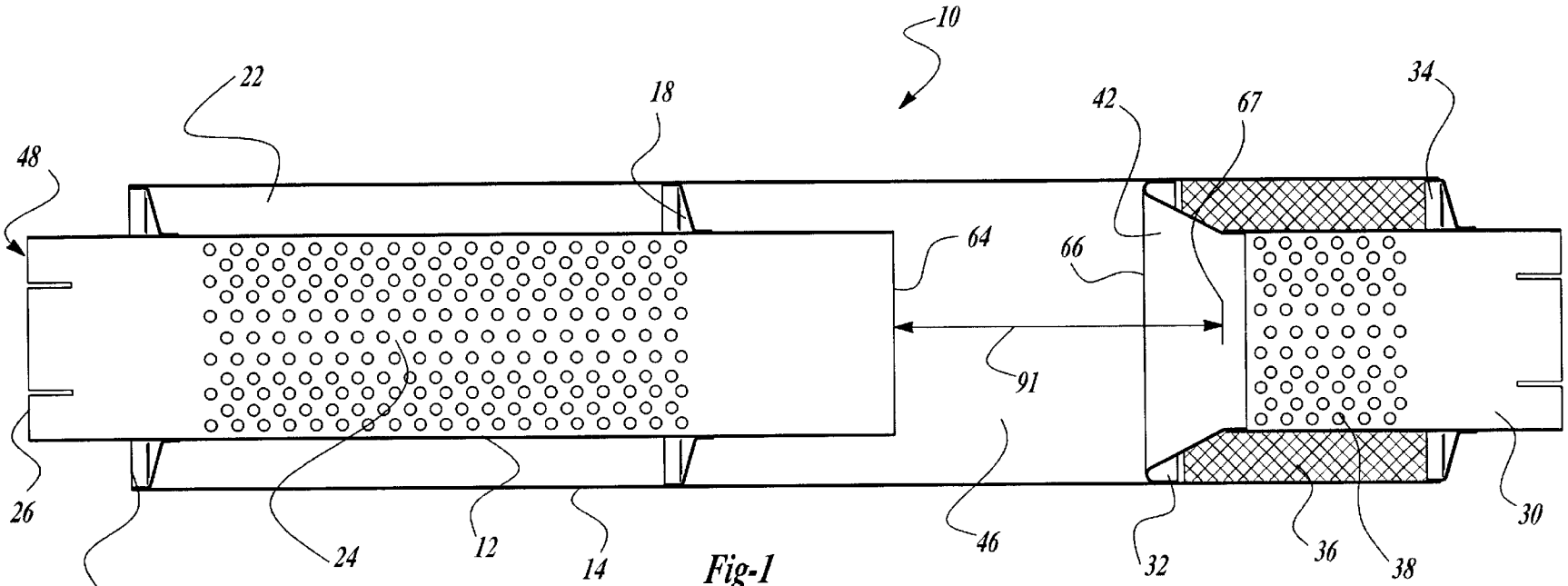
FIG. 1 is a cross-sectional view of a muffler according to a first embodiment of the present invention.

With reference to FIG. 1, a muffler 10 according to a first embodiment of the present invention is shown. Muffler 10 has an inlet tube 12 which is connected to outer shell 14 by first end cap 16 and first partition 18. First end cap 16, first partition 18, inlet tube 12 and outer shell 14 define the boundaries of a tuning chamber 22. Tuning chamber 22 is also known as a Helmholtz tuner in that its overall volume defines its resonant frequency and audible sound which is emitted when exhaust gas passes through inlet tube 12 (as will be discussed). Perforations 24 in inlet tube 12 allow air or exhaust gas within inlet tube 12 to communicate with tuning chamber 22. It is noted that inlet tube 12, first end cap 16, first partition 18, and outer shell 14 may be made of steel, aluminum, or any other material suitable for passing exhaust gas from an internal combustion engine to the atmosphere.

Adjustment of the distance between first end cap 16 and first partition 18 and the number of perforations in the inlet tube 12 alters the resonant frequency of tuning chamber 22 and thus alters the attenuation of tuning chamber 22 when exhaust gas passes through inlet tube 12. As such, first end cap 16 and first partition 18 may be repositioned and the number of perforations in the inlet tube 12 can be adjusted to attenuate different sounds. Preferably, in this embodiment, first end cap 16 and first partition 18 preferably are spaced a distance apart of approximately 3 to 4 times the diameter of inlet tube 12.

Outlet tube 30 is attached to outer shell 14 by flange area 32 of funnel shaped element 42 and second end cap 34. Similar to the tuning chamber 22, funnel shaped element 42, second end cap 34, outlet tube 30 and outer shell 14 enclose outlet chamber 36. Although outlet chamber 36 is preferably filled with fiberglass or other noise abating material, it is understood that outlet chamber 36 may be empty, thereby forming a Helmholtz tuner similar to tuning chamber 22. Outlet tube 30 has perforations 38 which allow air or exhaust gas within outlet tube 30 to communicate with outlet chamber 36.

Funnel shaped element 42 has a large diameter end 66 positioned in expansion chamber 46 and conically tapering to a junction 67 with a cylindrical neck element extending into the inlet end of outlet tube 30. Junction 67 of funnel shaped element 42 and second end cap 34 preferably are spaced a distance apart of approximately 2–3 times the diameter of inlet tube 12. However, it is noted that funnel shaped element 42 and outlet tube 30 are constructed as two separate pieces for manufacturing ease. Alternatively, funnel shaped element 42 and outlet tube 30 can be manufactured as a one piece construction, thereby eliminating any requirement for two separate pieces.

Preferably, large diameter end 66 is of a diameter to contact the inside diameter of outer shell 14 and which allows for the flow of exhaust gas into the funnel shaped element and through outlet tube 30. However, large diameter end 66 may be a smaller diameter than the inside diameter of outer shell 14.

Outer shell 14, funnel shaped element 42, second end cap 34, and outlet tube 30 define expansion chamber 46. Funnel shaped element 42, at flange area 32, and second end cap 34 are preferably spaced apart by a distance of 3 to 4 times the diameter of inlet tube 12. Expansion chamber 46 acts to provide attenuation to an exhaust stream passing therethrough by allowing sound pulses riding on the exhaust stream to expand into expansion chamber 46. The large distance 91 between junction 67 and end 64 provides the necessary room required for acoustic pulses from an exhaust stream to expand. The funnel shaped element 42 funnels and smoothes the turbulent flow of the exhaust stream back into outlet tube 30, thereby reducing back pressure. Although the preferred embodiment depicts the distance 91 between end 64 and junction 67 to be a distance apart of at least 2 to 3 times the diameter of inlet tube 12, it is noted that this dimension can and will change dependent on the geometry and dimension of the remaining components of muffler 10. The ideal distance 91 between end 64 and junction 67 is that which provides the best sound absorption characteristics while maintaining low back pressure. As such, it is understood that this dimension can be determined for any given geometry of muffler 10 without undue experimentation.

Figure 2:
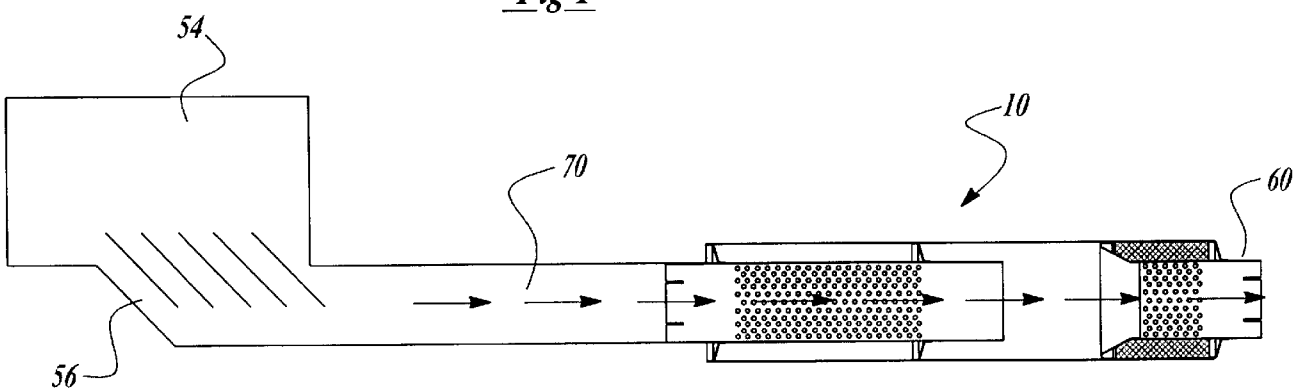
FIG. 2 is a perspective view of a muffler being used in conjunction with an internal combustion engine according to the present invention.

With references to FIGS. 1 and 2, the general operation of the present invention is now described. With continued reference to FIG. 2, internal combustion engine 54 supplies exhaust gases to exhaust manifold 56 which, in turn, supplies exhaust gas to muffler 10. Each cylinder of internal combustion engine 54 supplies a pulse of exhaust gas to exhaust manifold 56 during the exhaust portion of its combustion cycle, as is known. As such, the combined pulses of exhaust gasses fired into manifold 56 creates a repetitive pulse like low, hereinafter referred to as the exhaust stream 70. The repetitive pulses of the exhaust stream 70, entering the muffler 10 has a frequency dependent on engine speed. For purposes of this invention, exhaust stream 70 carries two components. First, exhaust stream 70 has acoustical pulses which define the sounds emitted by exhaust stream 70. Second, exhaust stream 70 has the flow of the actual exhaust gasses which muffler 10 vents to the external environment.

With continued reference to FIG. 1, the exhaust stream 70 enters inlet tube 12 at end 26, travels through expansion chamber 46 into outlet tube 30 and exits out tailpipe 60 (see FIG. 2). The acoustical portion of exhaust stream 70 travels back and forth through perforations 24 between tuning chamber 22 and inlet tube 12. This acoustical signal is attenuated by tuning chamber 22. Preferably, the volume of tuning chamber 22 is such that a low frequency in the range of 20 to 40 Hz is attenuated. It is noted that by changing the volume of tuning chamber 22, different acoustic frequencies are attenuated.

After chamber 22 attenuates, the exhaust stream 70 continues to chamber 46 and expands from inlet tube end 64. As that expansion occurs, the acoustic portion of the exhaust flow 70 is attenuated depending on the diameter of inlet tube 12, position of end 64, and the volume of chamber 46. It is noted that besides the volume and geometry of the chamber 46, the gap between end 64 and outlet tube 30 is maintained at a certain optimal distance to minimize back pressure. In the preferred embodiment, the distance 91 between end 64 and junction 67 is a ratio of 2 to 3 times the diameter of inlet tube 12.

Exhaust stream 70 next travels to outlet tube 30 from expansion chamber 46 through funnel shaped element 42. The funnel shape of funnel shaped element 42 acts to smooth the flow of exhaust stream 70, which has expanded due to expansion chamber 46, traveling into outlet tube 30. The large size of funnel shaped element 42 allows the distance between end 64 and junction 67 to be large while still smoothing the flow of exhaust system 70 from expansion chamber 46 into outlet tube 30. Moreover, by extending the large diameter end 66 of the funnel shaped element 42 to the walls of outer shell 14, all the flow is directed into funnel shaped element 42 and none can pass around it. This further decreases the back pressure created by expansion chamber 46.

Similar to tuning chamber 22, the acoustical portion of exhaust stream 70 within outlet tube 30 travels back and forth across perforations 38 thereby being attenuated by outlet chamber 36. The presence of sound abating material within outlet chamber 36 acts to further reduce or minimize any audible signals carried by exhaust stream 70 within outlet tube 30.

While the above detailed description describes the preferred embodiment of the present invention, it should be understood that the present invention is susceptible to modification, variation, and alteration without deviating from the scope and fair meaning of the subjoined claims.

What is claimed is:

1. A muffler comprising:

an outer shell having a first end cap and a second end cap;

an inlet tube passing through and supported by said first end cap; and an outlet tube having a funnel shaped element positioned within said outer shell and facing an end of said inlet tube, said outlet tube passing through and supported by said second end cap, said funnel shaped element having an open large diameter end having a cross sectional area larger than a cross sectional area of said inlet tube.

2. A muffler as claimed in claim 1, wherein a tuning chamber surrounds at least a portion of said inlet tube, said tuning chamber being in fluid communication with said inlet tube, said tuning chamber tuned to attenuate a first frequency range when an exhaust stream travels through said inlet tube.

3. A muffler as claimed in claim 1, wherein said inlet tube terminates in an expansion chamber, said inlet tube being in fluid communication with said expansion chamber, said expansion chamber tuned to attenuate a second frequency range when an exhaust stream travels from said inlet tube to said expansion chamber.

4. A muffler as claimed in claim 1, wherein said outlet tube is surrounded by an outlet chamber, said outlet tube being in fluid communication with said outlet chamber, said outlet chamber tuned to attenuate a third frequency range when an exhaust stream travels through said outlet tube.

5. A muffler as claimed in claim 1, wherein said large diameter end tapers to a junction, said inlet tube having an end in proximal location to said large diameter end of said outlet tube, said end of said inlet tube being spaced a distance of between 2 and 3 times a diameter of said inlet tube away from said junction.

6. A muffler for an internal combustion engine, said muffler comprising:

an outer shell having a first end cap and a second end cap;

an inlet tube inserted into said first end cap, said inlet tube being connected to said outer shell by a first partition and said first end cap, said inlet tube having a plurality of perforations, a tuning chamber defined by said inlet tube, said outer shell, said first partition and said first end cap;

an outlet tube having a funnel shaped element having an open large diameter end, said funnel shaped element inserted into said second end cap of said outer shell, said large diameter end of said funnel shaped element having a diameter larger than a diameter of said inlet tube, said outlet tube being connected to said outer shell by said funnel shaped element and said second end cap, said outlet tube having a plurality of perforations;

an outlet chamber defined by said outlet tube, said outer shell, said funnel shaped element and said second end cap; and said funnel shaped element positioned in an expansion chamber and conically tapering to a junction with a cylindrical neck element extending into an inlet end of said outlet tube.

7. The muffler as claimed in claim 6 wherein said outlet chamber is substantially filled with a noise abating material.

8. A muffler for an internal combustion engine, said muffler comprising:

an outer shell having a first end cap and a second end cap;

an inlet tube inserted into said first end cap, said inlet tube being connected to said outer shell by a first partition and said first end cap, wherein said first partition and said first end cap are spaced at a distance apart of between 3 and 4 times a diameter of said inlet tube;

a tuning chamber defined by said inlet tube, said outer shell, said first partition and said first end cap;

an outlet having a funnel shaped element having a large diameter end, said funnel shaped element inserted into said second end cap of said outer shell, said large diameter end of said funnel shaped element having a diameter larger than said diameter of said inlet tube, said outlet tube being connected to said outer shell by said funnel shaped element and said second end cap, said outlet tube having a plurality of perforations;

an outlet chamber defined by said outlet tube, said outer shell, said funnel shaped element and said second end cap; and said funnel shaped element positioned in an expansion chamber and conically tapering to a junction with a cylindrical neck element extending into an inlet end of said outlet tube.

9. The muffler as claimed in claim 6, wherein said large diameter end of said funnel shaped element is positioned in proximal location to an end of said inlet tube, said junction being spaced at a distance of between 2 and 3 times a diameter of said inlet tube from said end of said inlet tube.

10. The muffler as claimed in claim 6, wherein said large diameter end of said funnel shaped element has a diameter substantially equaling a diameter of said outer shell.

* * * * *